US009586153B2

(12) United States Patent
Saunders

(10) Patent No.: US 9,586,153 B2
(45) Date of Patent: Mar. 7, 2017

(54) TOY FIGURE WITH MOVABLE APPENDAGE

(71) Applicant: Mattel, Inc., El Segundo, CA (US)

(72) Inventor: Jeffrey Alan Saunders, Redondo Beach, CA (US)

(73) Assignee: Mattel, Inc., El Segundo, CA (US)

( * ) Notice: Subject to any disclaimer, the term of this patent is extended or adjusted under 35 U.S.C. 154(b) by 246 days.

(21) Appl. No.: 14/267,562

(22) Filed: May 1, 2014

(65) Prior Publication Data

US 2014/0329434 A1 Nov. 6, 2014

Related U.S. Application Data

(60) Provisional application No. 61/819,311, filed on May 3, 2013.

(51) Int. Cl.
*A63H 3/20* (2006.01)

(52) U.S. Cl.
CPC ..... *A63H 3/20* (2013.01)

(58) Field of Classification Search
CPC ..... A63H 3/20
USPC ..... 446/330, 334, 335, 336, 352, 354
See application file for complete search history.

(56) References Cited

U.S. PATENT DOCUMENTS 2,277,762 A 3/1942 Irenius
3,758,982 A 9/1973 Lemelson et al.
3,775,900 A * 12/1973 Thorn ..... A63H 13/005 446/354
3,862,513 A * 1/1975 Isaacson ..... A63H 3/20 273/108.22
3,955,311 A 5/1976 Lyons et al.
4,126,961 A 11/1978 Barlow et al.
4,579,542 A 4/1986 Mayer et al.
4,657,518 A * 4/1987 Kelley ..... A63H 3/48 185/39
4,680,019 A 7/1987 Baerenwald et al.
4,985,008 A * 1/1991 Price ..... A63H 13/06 446/308
5,176,560 A * 1/1993 Wetherell ..... A63H 11/18 446/175
5,423,708 A 6/1995 Allen
6,022,263 A * 2/2000 Liu ..... A63H 3/20 446/330
6,132,285 A 10/2000 Feldman
6,224,456 B1 5/2001 Wittenberg
6,267,640 B1 7/2001 Akashi et al.
6,500,044 B1 12/2002 Sasuga et al.
6,579,143 B1 * 6/2003 Rehkemper ..... A63H 13/12 446/175

(Continued)

*Primary Examiner* — Melba Bumgarner
*Assistant Examiner* — Joseph B Baldori
(74) *Attorney, Agent, or Firm* — Kolisch Hartwell, P.C.

(57) ABSTRACT

A toy appendage assembly includes an elongated member, an offset shaft having a first end coupled to a coupling end of the elongated member, and a wheel coupled to a second end of the offset shaft. The offset shaft is coupled to the wheel at a location away from the center of the wheel. The coupling end of the elongated member is at least partially spherical in shape and is capable of rotating within a support structure. The elongated member has a first axis, and the offset shaft has a second axis, where the first axis is angularly offset from the second axis. The coupling end serves as a pivot point for the elongated member and the offset shaft.

18 Claims, 12 Drawing Sheets

(56) References Cited

U.S. PATENT DOCUMENTS

| | | | | |
|---|---|---|---|---|
| 6,843,703 | B1 | 1/2005 | Iaconis et al. | |
| 7,364,489 | B1 | 4/2008 | Iaconis et al. | |
| 7,654,881 | B2 * | 2/2010 | Nakazato ..... | A63H 13/06<br>446/334 |
| 7,901,265 | B1 | 3/2011 | Cameron et al. | |

* cited by examiner

TOY FIGURE WITH MOVABLE APPENDAGE

RELATED APPLICATIONS

This application claims priority to U.S. Provisional Patent Application No. 61/819,311 filed on May 3, 2013 and entitled "Toy Figure With Movable Appendage," which is hereby incorporated by reference for all purposes.

BACKGROUND

Toy dolls and figures have been a long-standing popular play item for children. Many types of features for toy dolls have been introduced over the years, such as movement of various body parts, hair play, sound production, and simulation of realistic activities such as feeding and sleeping. Features for movement of body parts have included, for example, movable arms and legs, rotatable heads and bendable torsos.

Yet, there continues to be a need for unique features in toy dolls and figures to increase interest and enhance creative play.

SUMMARY

A toy appendage assembly includes an elongated member, an offset shaft having a first end coupled to a coupling end of the elongated member, and a wheel coupled to a second end of the offset shaft. The offset shaft is coupled to the wheel at a location away from the center of the wheel. The coupling end of the elongated member is at least partially spherical in shape and is capable of rotating within a support structure. The elongated member has a first axis, and the offset shaft has a second axis, where the first axis is angularly offset from the second axis. The coupling end serves as a pivot point for the elongated member and the offset shaft.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION

This disclosure relates to toy figures with movable appendages. Appendages are coupled in an offset configuration to an actuation assembly, to produce unique movement such as a non-circular motion. The actuation assembly may include an actuation element, such as a lever or button, that is actuated by a user. The appendage is coupled to the actuation assembly with a shaft that is angularly offset from the appendage, where the shaft may be driven by a gear and wheel mechanism. The shaft is attached off-center on the wheel, and pivots the appendage around its coupling end. Additional embodiments may include features to produce irregular motion, thus resulting in unexpected actions and increasing play value. Although the drawings herein shall be shown in relation to a toy doll, the concepts are applicable to other types of objects such as animals, robots, or vehicles.

Figure 1:
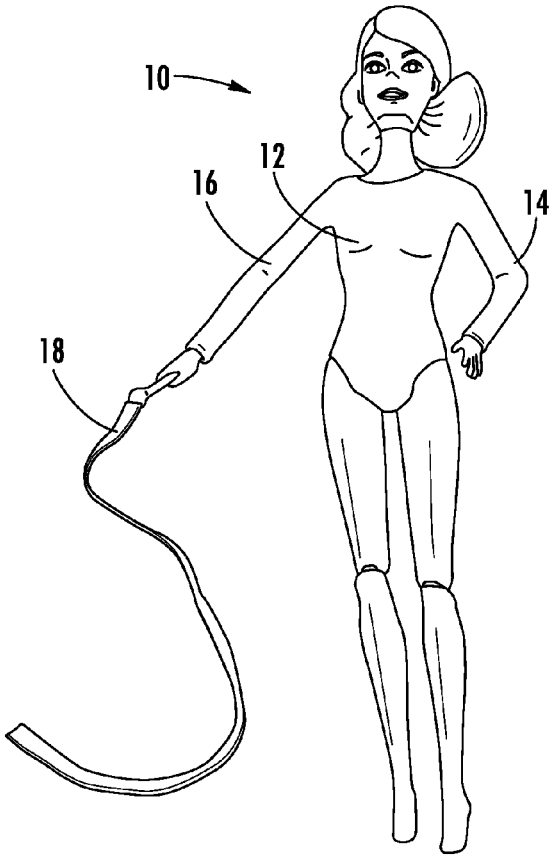
FIG. 1 is a front view of an exemplary toy assembly.
Figure 2:
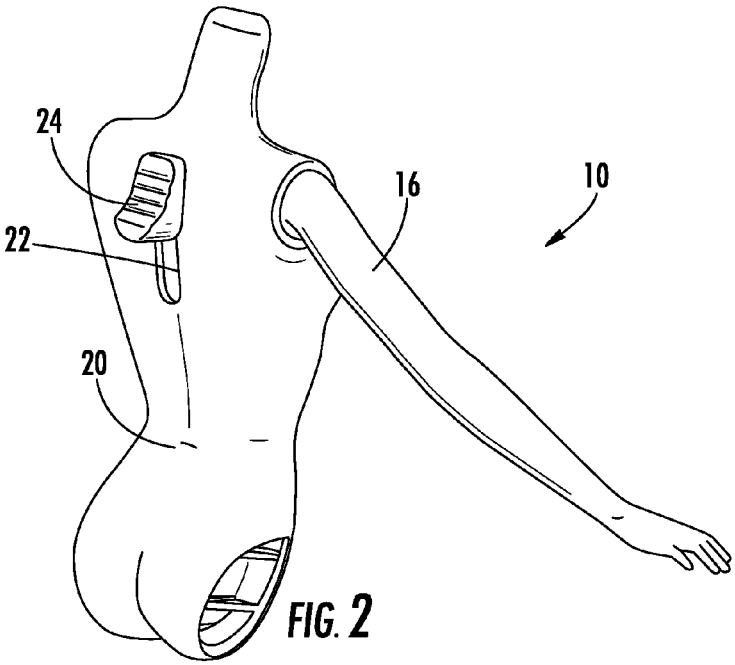
FIG. 2 is a partial back perspective view of an embodiment of an actuation element and a rotating appendage.

FIG. 1 shows an exemplary toy doll 10 with movable arms and legs. In this embodiment, the doll 10 is configured to simulate gymnastics play. The doll 10 includes a torso 12 with a pivotally coupled arm 14 and an arm 16 that is movable for enacting athletic movements such as waving or twirling a ribbon 18 that is being held by the doll. The doll 10 includes an actuator 24, such as a lever or button, on its back 20, as shown in FIG. 2. The actuator 24 is used for actuating movement of at least one of the doll's arms, such as arm 16. As shown, the back 20 of the doll 10 includes a slot 22 formed therein in which the actuator 24 is movably positioned. In other embodiments, toy figures may be configured, for example, to simulate dancing, running, jumping, or moving of linkages in a vehicle or robot. Similarly, while the appendage is depicted as an arm in this disclosure, the appendage may be an elongated member of other configurations, such as a leg, a tail, or a rod extending from a machine.

Figure 3:
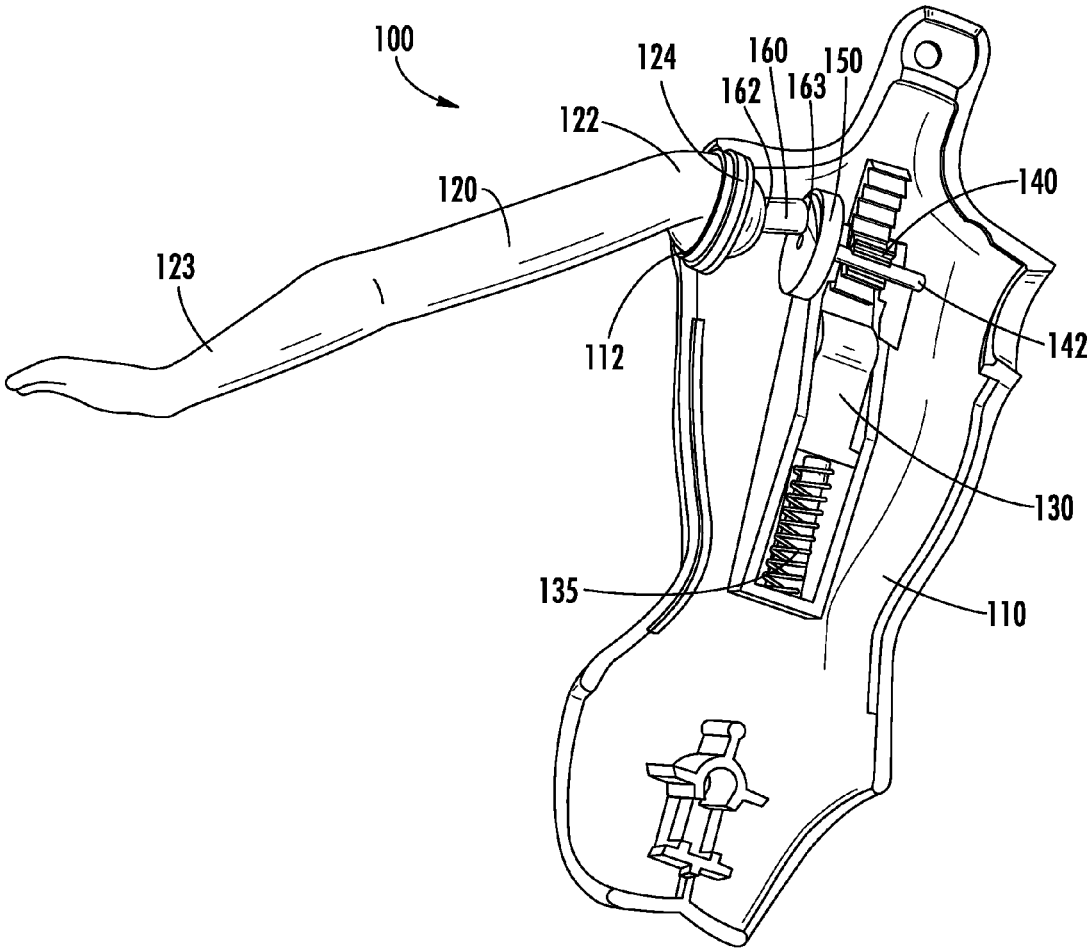
FIG. 3 shows exemplary components of an actuation assembly for an offset rotating appendage, seated in the back half of a torso.
Figure 4:
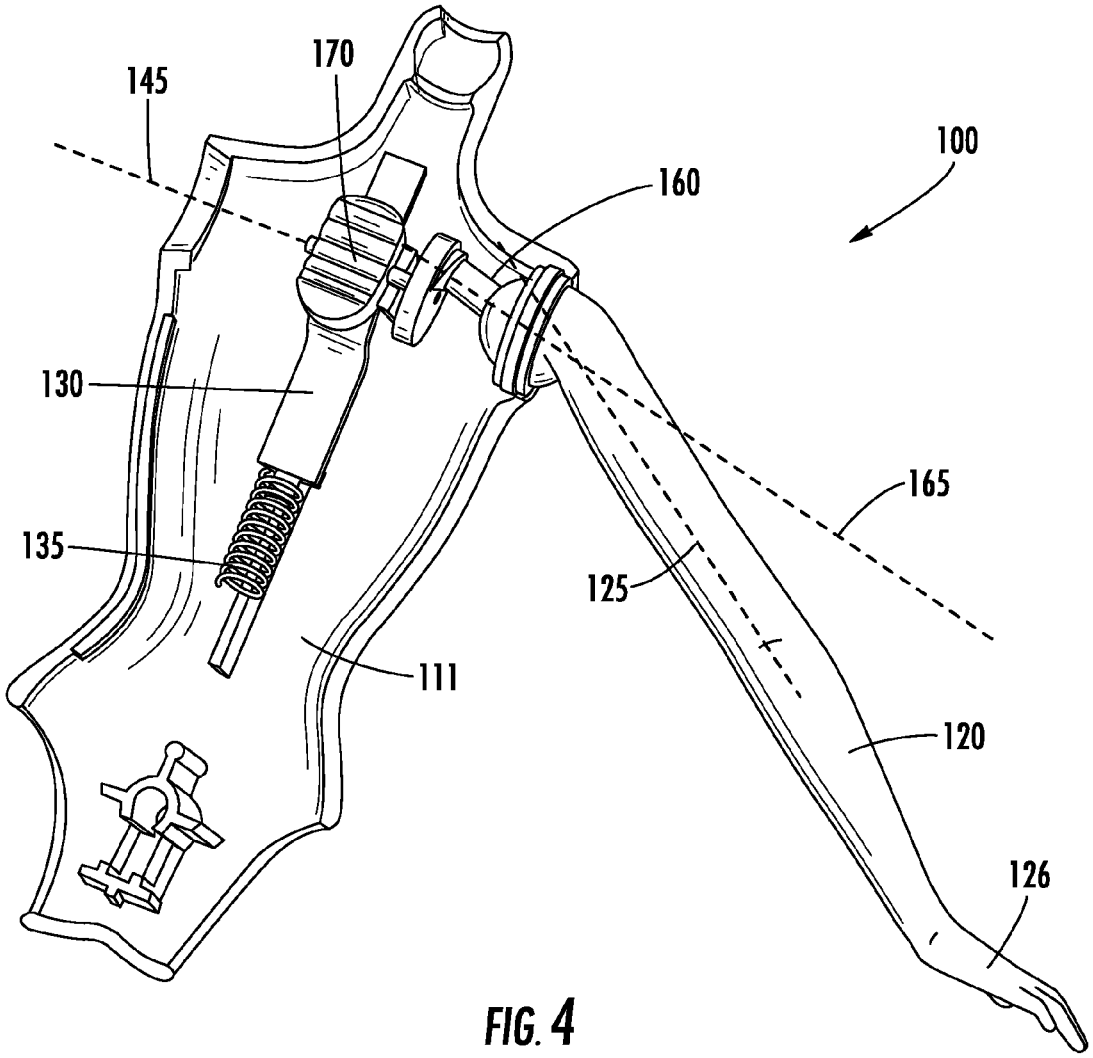
FIG. 4 shows another view of the assembly of FIG. 3, seated in the front half of the torso.

FIGS. 3 and 4 provide perspective views of actuation assembly components in the interior of a doll 100, in one embodiment. In FIG. 3, the doll 100 includes a back half 110 of a main body or torso, an arm 120, a gear rack 130 with several teeth on at least a portion of its length, a spring 135, a gear 140 with an axle 142 running through it, a wheel or disk 150, and an offset shaft 160. Arm 120 has a coupling end 122 at one end, and a moving end 123 at the opposite end. Coupling end 122 is positioned in an opening 112 in the wall of torso 110, and is configured to be at least partially spherical so that it is capable of universal rotation. For example, coupling end 122 may be shaped as a sphere—except for where the arm 120 extends from coupling end 122—to form a ball and socket joint with the arm opening 112 of torso 110. In other embodiments, coupling end 122 may be at least partially spherical, such as being curved on the surfaces that contact the arm opening 112, but being flat or otherwise shaped where offset shaft 160 is attached. The opening 112 provides a support structure for coupling end 122. In some embodiments, the support structure for coupling end 122 may also include a support ring 124, which is seated in opening 112 and surrounds the coupling end 122 which forms the shoulder area or arm 120. FIG. 4 shows the actuation components of FIG. 3 seated in the front half 111 of the torso of doll 100, and additionally shows an actuation element embodied 170 as a sliding button, that is coupled to the back side of gear rack 130.

In the embodiments of FIGS. 3 and 4, gear rack 130 is configured to slide lengthwise along the spine of the back half 110 of the doll's torso. Gear 140 engages the teeth of gear rack 130, and rotates on axle 142 that is perpendicular to the movement direction of gear rack 130. When a user slides actuation element 170 relative to the body of the doll 100, such as in the slot 22 shown in FIG. 2, gear rack 130 moves with it, which consequently turns gear 140 about its axle 142. In other embodiments, the actuation element may be, for example, a push button, a pivoting element such as a rod or rocker arm, a rotating element such as a rotating knob or slide wheel, or the like. Gear 140, via the axle 142 running through its center, then turns or rotates wheel 150 which also rotates on axle 142. As wheel 150 turns, the offset shaft 160 turns with it. Offset shaft 160 has a first end 162 coupled to the coupling end 122 of arm 120, and a second end 163 coupled to wheel 150. In this embodiment, end 122 of offset shaft 160 is fixedly coupled to the coupling end 122. The end 163 of offset shaft 160 is coupled to the wheel 150 at a location away from the center of wheel 150, such that the end 163 of offset shaft 160 follows a circular path about the axis 145 of rotation of the wheel 150, as wheel 150 turns.

Furthermore, as shown in FIG. 4, offset shaft 160 has an axis 165 along its length that is not aligned with the axis 125, where axis 125 is along the length of arm 120. For example, axis 165 and axis 125 may be offset from each other by an angle between 0-90°, such as 5-30°. Central axis of rotation 145, around which the gear 140 and wheel 150 turn, is also angularly offset, or non-parallel, from axis 165. As the offset shaft 160 revolves with the rotation of the wheel 150, arm 120 is consequently rotated, using the ball joint of coupling end 122 as a pivot point for the elongated member arm 120 and the offset shaft 160. In various embodiments, the wheel 150 may rotate a full 360°, or a portion thereof, such as 45-120°. The wheel 150 may also rotate in either direction, such as clockwise or counter-clockwise, to allow a wide range of movement options for the user. Because axis 125 of arm 120 and axis 165 of offset shaft 160 are angularly offset from each other, the circular motion of wheel 150 results in a non-circular movement of the moving end 123 arm 120 when the arm 120 is pivoted about the coupling end 122. For example, the hand 126 on arm 120 may follow an elliptical path when a user activates the button 170 to move arm 120. This non-circular motion adds play value by bringing unique movement to the doll. The pivot point at the ball joint (coupling end 122) of the arm 120 also serves to amplify motion of the hand compared to the smaller movement of the offset shaft 160 on the wheel 150. In the gymnastics doll 10 of FIG. 1, for instance, more creative play scenarios may be imagined using the unexpected motion of the arm 120.

Additionally, use of an actuation element to actuate the movement allows for more rapid sequences than, for example, requiring a user to manually move and reposition the arm. In some embodiments, spring 135 or other biasing element assists in movement of the button 170. For example, spring 135, which is aligned with the travel path of gear rack 130 and coupled adjacently to an end of gear rack 130 in this embodiment, is a compression spring to return the lever from a displaced position to its initial position. In addition, spring 135 provides a force that is applied to the gear rack 130, which increases the variability of the movement of the arm 120. Thus with spring 135 incorporated, a user may slide the button 170 downward to initiate a first movement of the arm. Releasing the button 170 will then cause the spring 135 to slide gear rack 130 back upwards and create additional arm movement. In other embodiments, the spring 135 may be omitted such that the user manually moves the actuating element back and forth.

Figure 5:
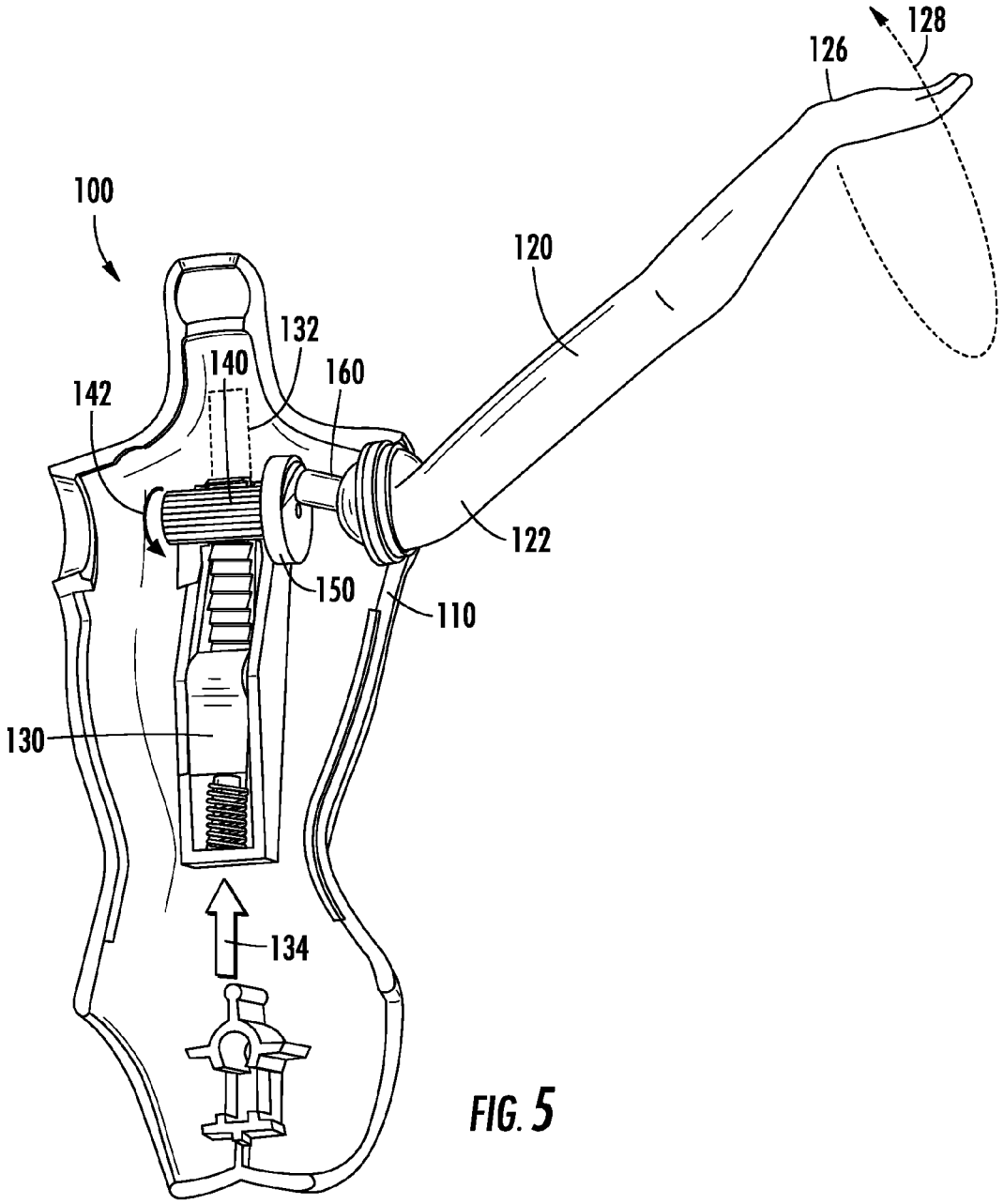
FIG. 5 is another view of the assembly of FIG. 3.

FIG. 5 shows a simplified view of the doll assembly 100 in which the arm 120, gear rack 130, gear 140, wheel 150, and offset shaft 160 are shown. Coupling end 122 of arm 120 is mounted into the torso 110, while a hand 126 is at the opposite end, which is the moving end of arm 120. The gear rack 130 in FIG. 5 is shown in an initial position along its travel path. Sliding the gear rack 130 upward to position 132 indicated by dashed lines and arrow 134, such as by actuation element 170 of FIG. 4, causes gear 140 to rotate as indicated by arrow 142. Rotation of the offset shaft 160 moves the arm 120 and hand 126 of the doll back and forth in an elliptical type pattern 128, rather than in a circle as would occur if the axes 125 and 165 (FIG. 4) were parallel.

In some embodiments, the gear 140 and gear rack 130 may be loosely coupled, to result in erratic motion of the arm 120 as the gear rack 130 is actuated. For example, gear 140 and gear rack 130 may be configured with a small amount of clearance between interfacing teeth, or may be configured such that the gear rack 130 may deflect slightly away from gear 140 when gear rack 130 is slid. This spasmodic motion can increase the entertainment value of the toy assembly because of the unpredictable nature of movement that is produced.

Figure 6:
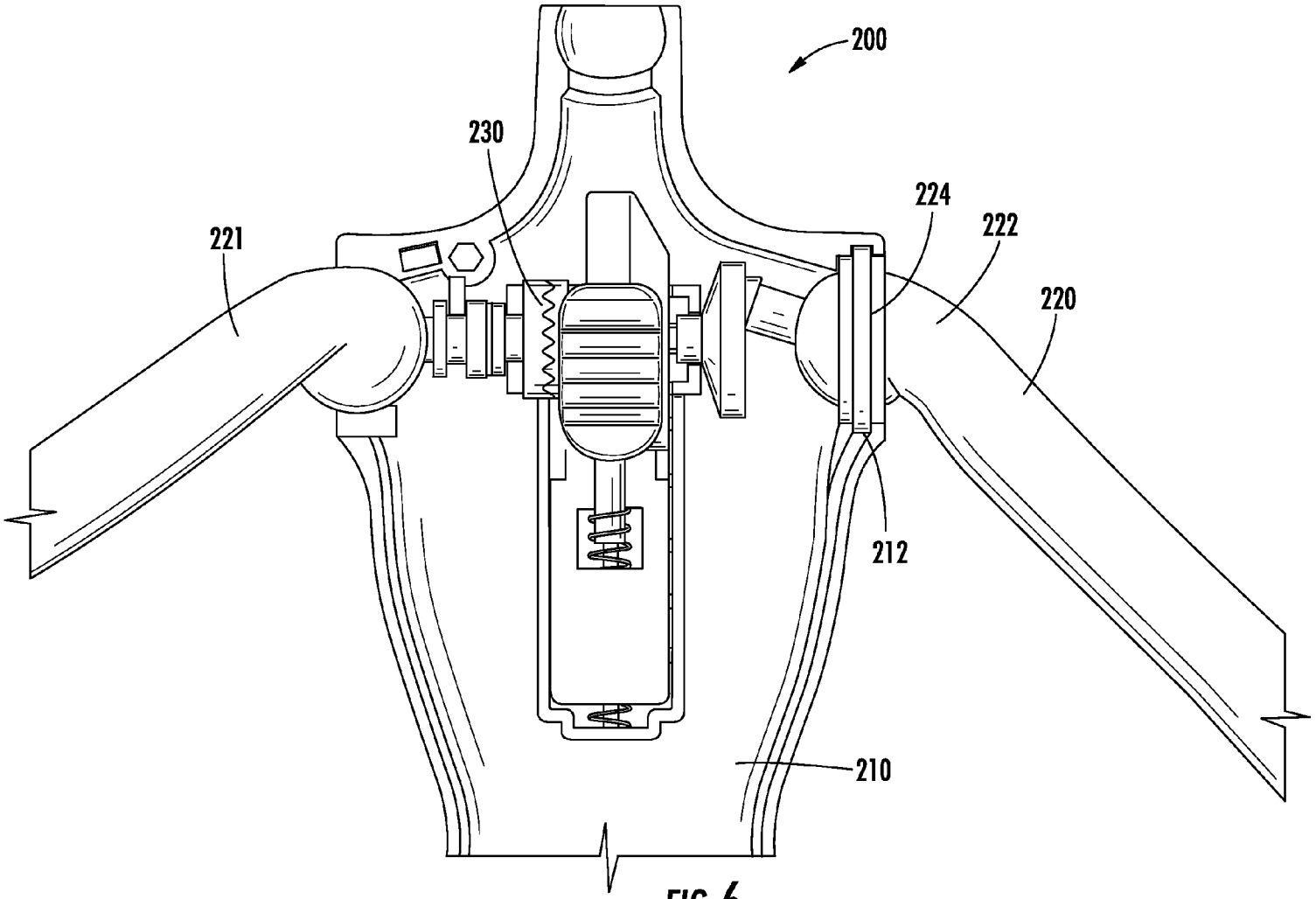
FIG. 6 shows components of another exemplary toy assembly, with two types of movable arms.

FIG. 6 shows a cross-sectional view of another embodiment of a toy assembly 200 with an offset rotating arm 220. In this embodiment, a support ring 224 is seated in the arm opening 212 of torso 210, and serves as a support structure for coupling the end 222 of arm 220 to torso 210. The inner surface of support ring 224 is configured to allow universal rotation of arm 220, such as to form a ball and socket joint between ring 224 and end 222 of arm 220. For example, the inner surface of support ring 224 may have a curvature that substantially matches the shape of end 222 of arm 220. In some embodiments, support ring 224 may be configured to provide resistance against rotation of arm 220, such that randomized movement of the elongated member may be produced as the arm sticks or slips against friction with the support ring 224. For example, the resistance may be achieved by surface texturing or through the materials used for the components. This randomized motion can add further entertainment to the user. FIG. 6 additionally shows a second arm 221, opposite of arm 220. The second arm 221 in this embodiment is not coupled to the same gear assembly that drives arm 220, and is manually adjustable. That is, arm 221 may be decoupled from the motion of arm 220 by the gear 230. Thus, arm 221 provides a different motion from arm 220. The contrasting arm motion capabilities can also provide play value to the operator.

Figure 7:
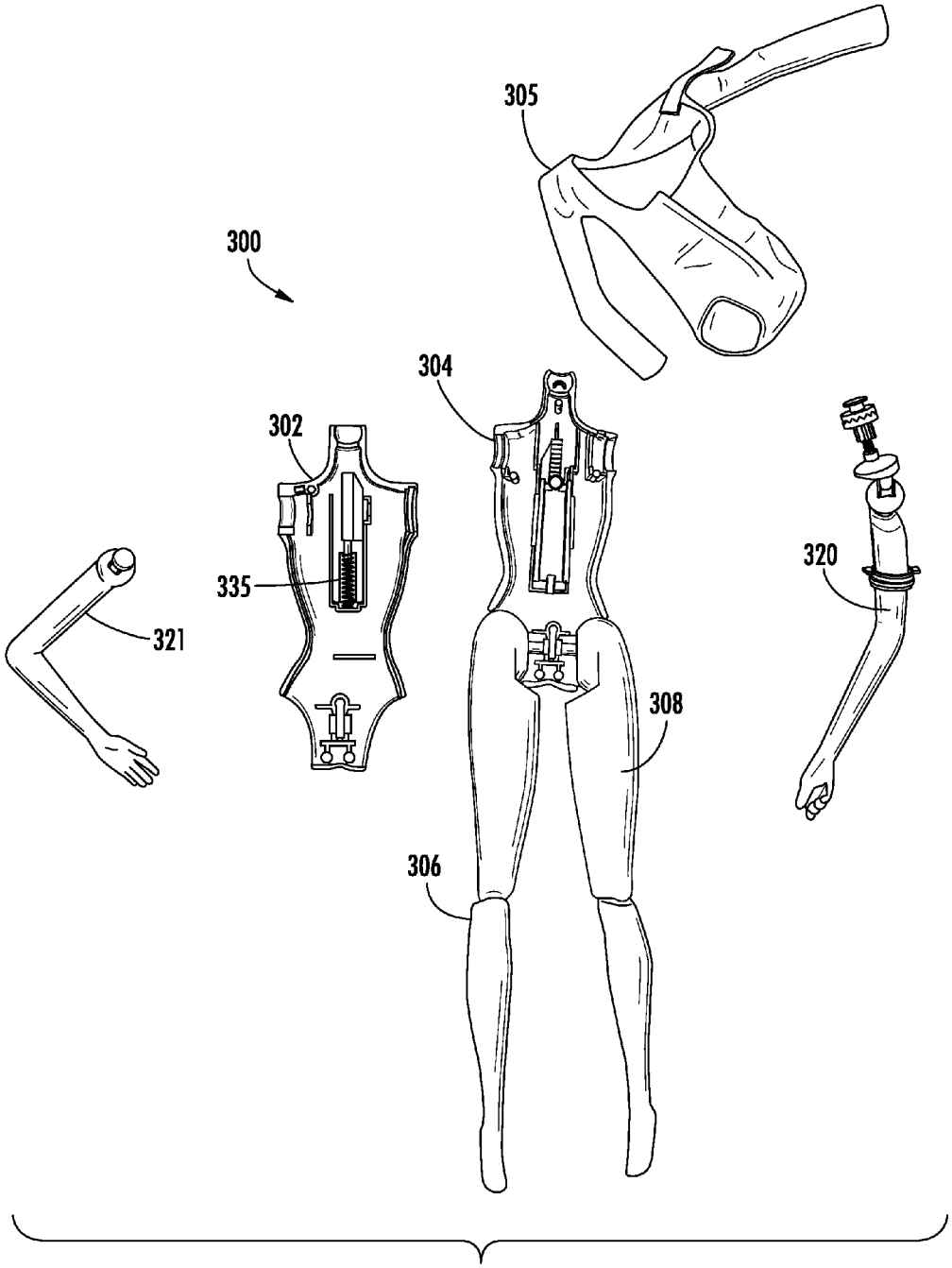
FIG. 7 shows components of a complete doll assembly, in one embodiment.

FIG. 7 shows components of another embodiment of a toy assembly 300, including a front torso half 302, a back torso half 304 with leg appendages 306 and 308 attached, two arms 320 and 321, and an exemplary outfit 305 that may be worn by the doll assembly 300. Arm 320 is an elongated member configured as an offset rotating appendage, while arm 321 is configured to be concentrically rotating.

Figure 8:
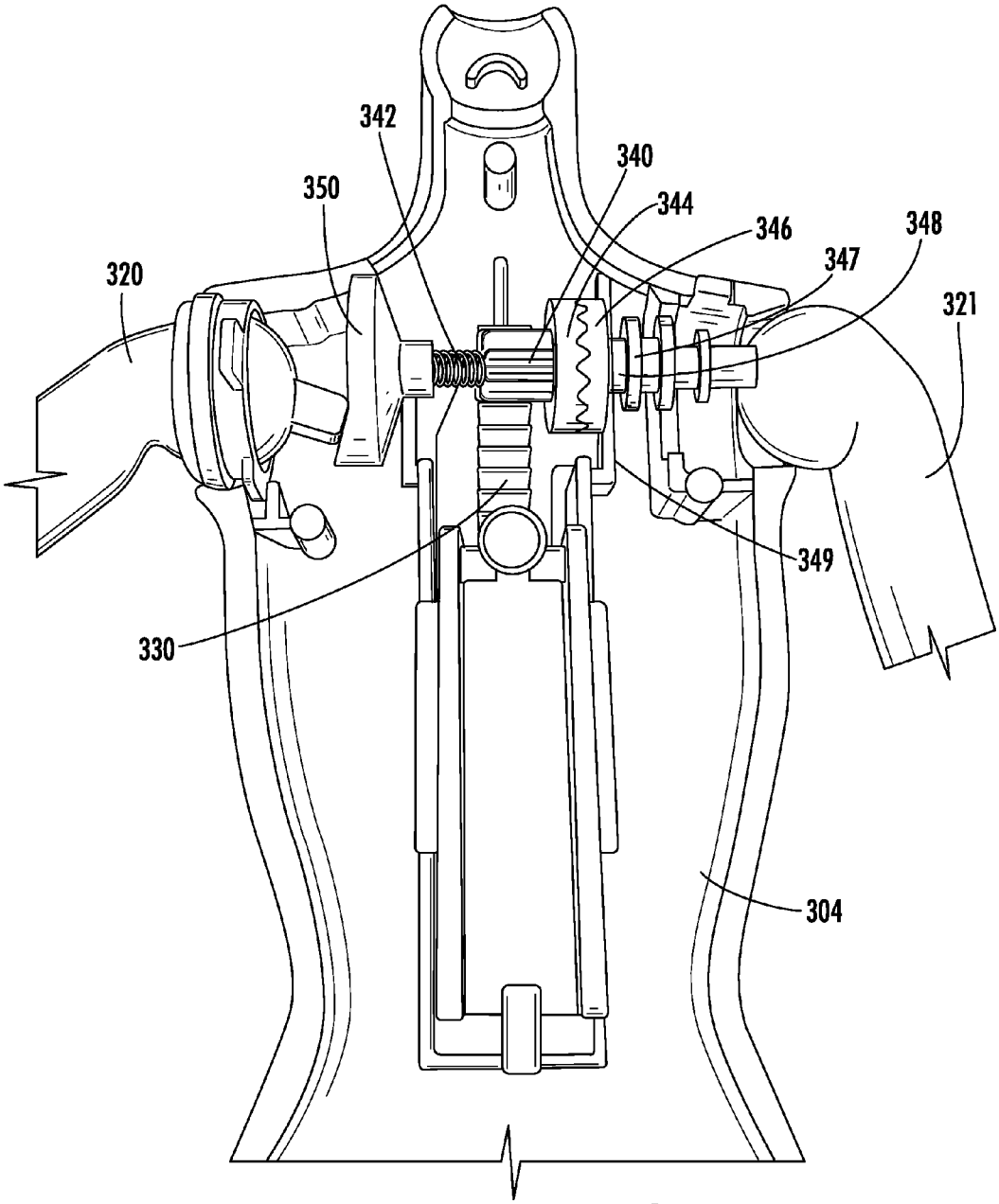
FIG. 8 provides a detailed view of a portion of the assembly of FIG. 7.

FIG. 8 shows a view of the assembly of FIG. 7 with both arms 320 and 321 mounted in place, where it can be seen that the central gear 340 drives both arms 320 and 321. A spring 342 is included in this embodiment on the axle that is located between the gear 340 and wheel 350. The spring 342 is positioned between the gear 340 and the wheel 350. Integrally formed with the gear 340 is a crown gear 344 that is engaged with another crown gear 346. In some embodiments, the crown gears 344 and 346 are fixedly coupled to each other and do not move relative to each other. In alternative embodiments, the crown gears 344 and 346 are movable relative to each other and function together to form a clutch, so that the motion of arms 320 and 321 may be decoupled from each other.

Formed with gear 346 is an extension with a plate 347 parallel to gear 346, that defines a groove or space 348 between the plate 347 and the gear 346. Groove 348 is engaged by the plate or wall 349 that is formed in the back torso 304. A similar wall is formed on the inner surface of the other torso portion (front torso half 302), to form a cavity for holding the components of the actuation assembly. The walls engage the groove 348 to maintain the position of the gears 346 and 344 in the torso 302/304 and to ensure that gear 340 is properly positioned for engagement with the gear rack 330.

Figure 9:
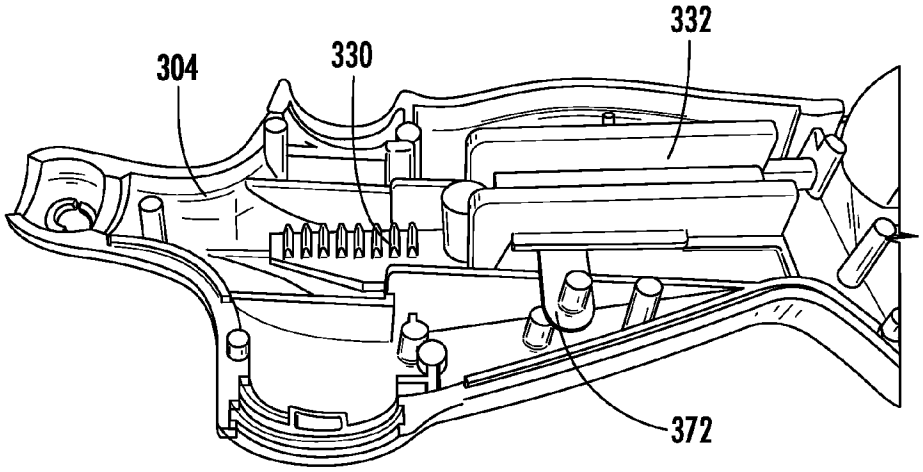
FIG. 9 is a side perspective view of the gear rack of FIG. 8.
Figure 10:
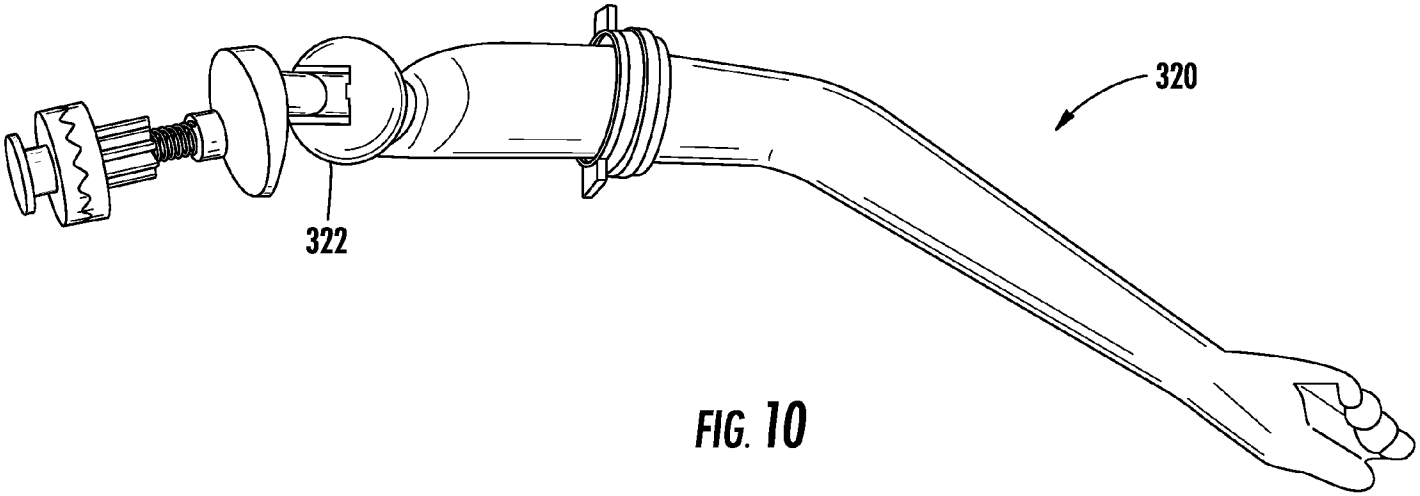
FIG. 10 is a perspective view of one of the arms of FIG. 7.
Figure 11:
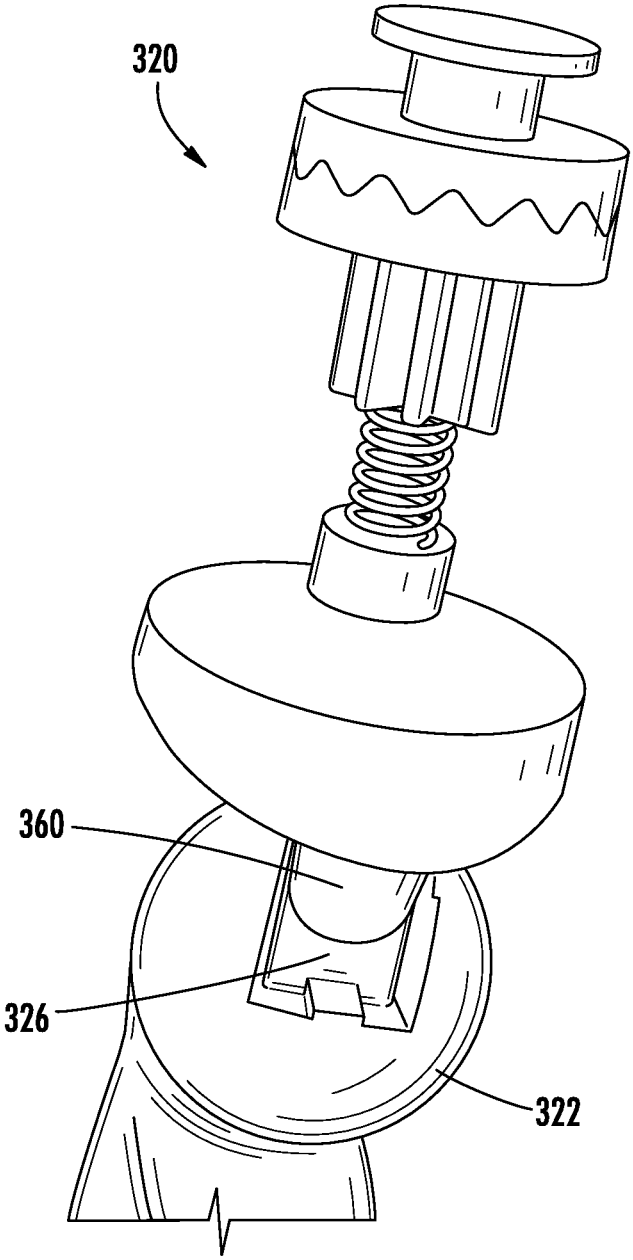
FIG. 11 provides a close-up view of the arm of FIG. 10.

FIG. 9 shows a side view of the back torso 304 of FIG. 8, including an embodiment of the gear rack 330 and a plate 372 that is used to guide the movement of the gear rack 330 relative to the rear torso portion. The plate 372 enables the actuation element, such as button 170 of FIG. 4, to move the gear rack 330 in a defined path as the actuation element is moved. The gear rack 330 of FIG. 9 also includes a trough area 332 into which the spring 335 (FIG. 7) may be housed. Spring 335 or other biasing element may be used to return an actuation element from a displaced position back to its initial position, as described in relation to spring 135 of FIGS. 3 and 4. In this embodiment, spring 335 is an extension spring that lies within trough area 332 when the doll 300 is assembled, to pull gear rack 330 from a displaced position back into its resting position.

FIGS. 10-13 show full and close-up views of arm 320. In this embodiment, the coupling end 322 of arm 320 also includes a joint 326 (FIG. 11) between offset shaft 360 and the ball joint end 322 of arm 320. In one embodiment, the joint 326 is fixed so that the arm 320 does not move relative to the offset shaft 360. In an alternative embodiment, joint 326 is a pivoting joint that enables an additional degree of freedom in the motion that arm 320 is able to produce. As mentioned above, in other embodiments, the offset shaft 360 may be fixedly attached directly to the ball joint (e.g., FIG. 4), rather than including a joint 326.

Figure 12:
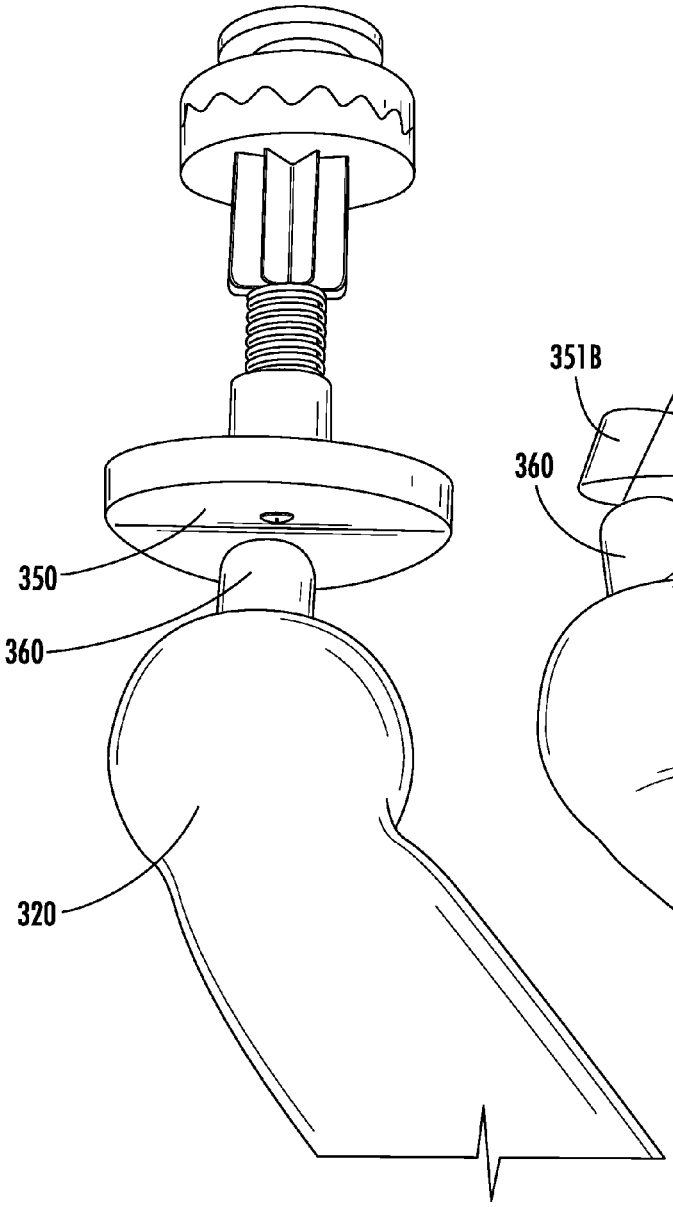
FIG. 12 is a yet further close-up view of the arm of FIG. 10.
Figure 13:
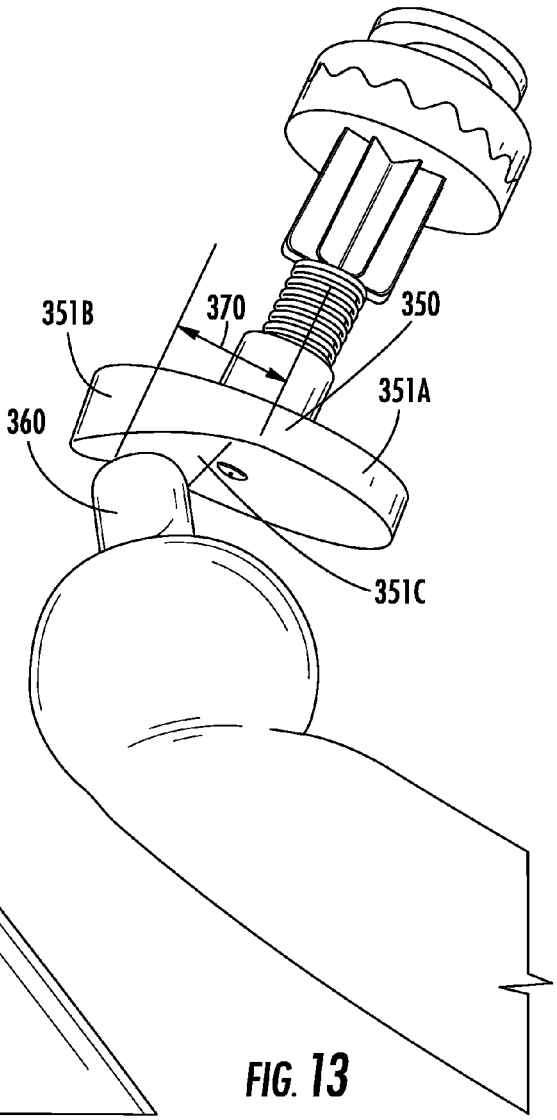
FIG. 13 is another view of the arm of FIG. 12, with the arm rotated in a different position.

FIGS. 12 and 13 demonstrate the disk or wheel 350 rotated in two positions, showing the angular offset of shaft 360, and also showing that the offset shaft 360 is coupled non-concentrically to wheel 350, by a distance 370. The wheel 350 has a non-uniform profile and thickness in this embodiment. In particular, the wheel 350 has a planar, main body portion 351A and an angled or inclined thicker portion 351B. The angled portion 351B has a surface 351C that is inclined relative to the main body portion 351A, with the offset shaft 360 being coupled to inclined portion 351B. The inclination of surface 351C to which the offset shaft 360 is coupled adds to the variable movement of the arm 320.

Figure 14:
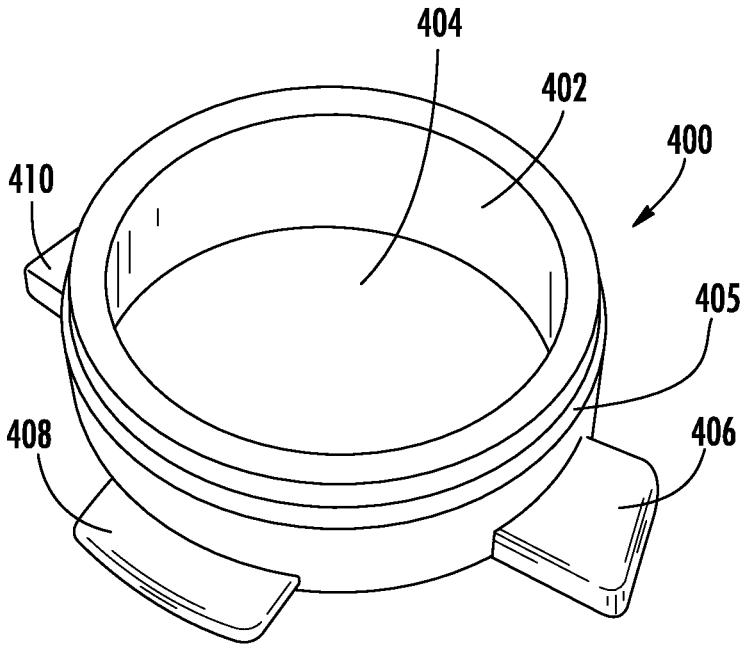
FIG. 14 illustrates a perspective view of an exemplary support ring.
Figure 15:
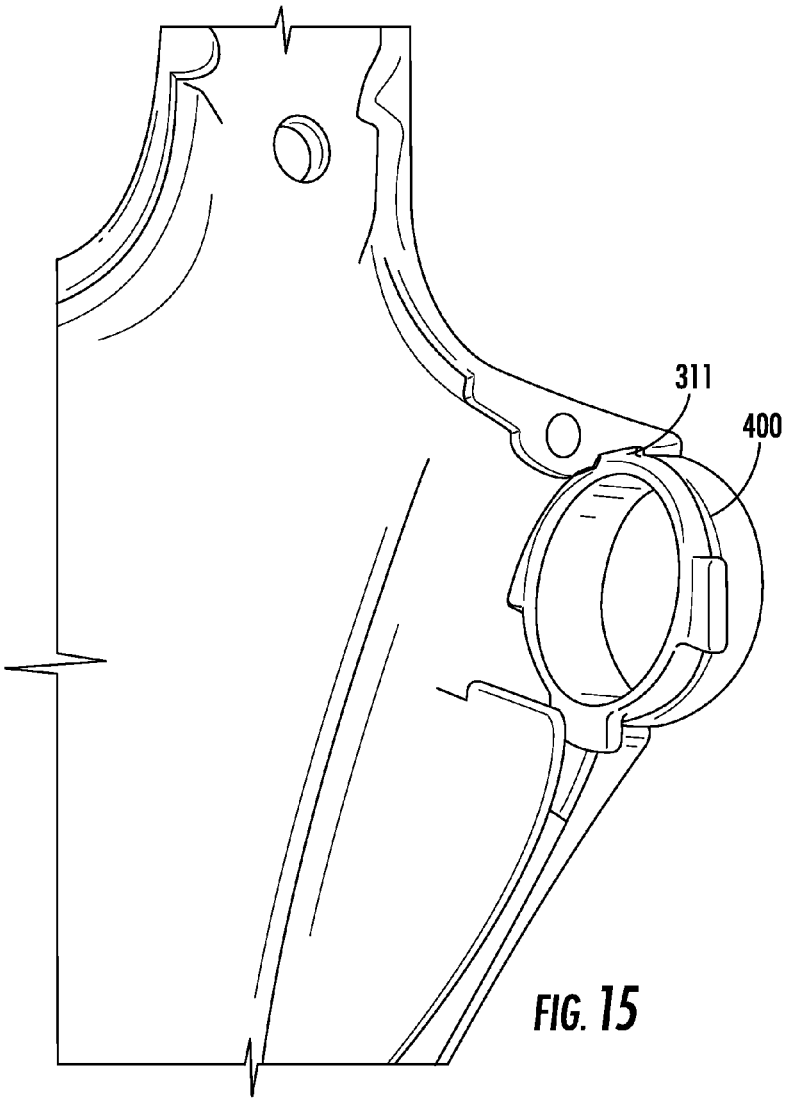
FIG. 15 shows the support ring of FIG. 14 mounted in a main body, in one embodiment.

FIG. 14 illustrates an exemplary support ring 400 that may be used in yet further embodiments. As described above in relation to the support ring 224 of FIG. 6, the support ring 400 of FIG. 14 may be placed in an opening of the main body of the toy doll, as shown in FIG. 15, to serve as a support structure in which the coupling end of the elongated member—the offset, movable appendage—rotates. Referring FIG. 14, the ring 400 has an inner surface 402 that defines a passageway 404 through which the shoulder joint of the arm extends. The ring 400 includes an outer ridge 405 and three protruding tabs 406, 408, and 410. The tabs 406, 408, and 410, which extend radially from the ring 400 in this embodiment, as well as the ridge 405 around its outer periphery, are used to mount the ring 400 relative to the torso of the doll. In other embodiments, the number of tabs or the configuration of the ridge may be varied, or other features may be utilized to mount the ring 400 such as nubs, detents, or locking tabs.

Figure 16:
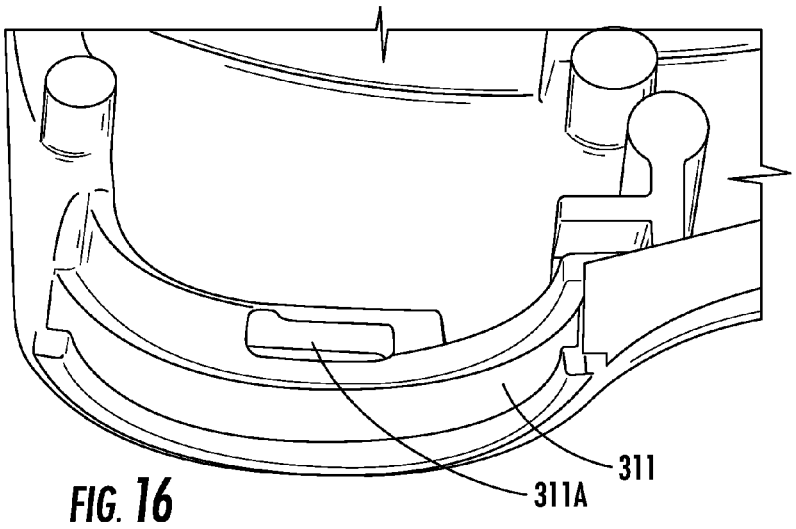
FIG. 16 is a close-up view of an exemplary opening for receiving the support ring of FIG. 15.

Referring to FIG. 16, the inner surface of the doll torso includes a groove 311 that is configured to receive the ridge 405 on the ring 400. In addition, each of the front torso and the rear torso pieces includes a slot 311A that is configured to receive one of the tabs 406 and 410, with tab 408 being captured between the two torsos. The inner surface 402 of the support ring 400 is configured to receive the coupling end of the offset appendage and allow it to rotate. For example, the inner surface 402 may be rounded or spherically contoured to create a ball and socket type of joint. In other embodiments, the inner surface 402 may be configured to provide resistance as the arm rotates within the ring. This resistance may produce random movements as the arm is actuated by the actuation element, thus creating unpredictable motion and increasing the play value of the toy. For instance, the tolerance between the inner diameter of the ring 400 and the outer diameter of the shoulder joint may have a particular tightness or may vary around the circumference to cause random sticking and slipping of the arm. In other embodiments, the inner surface 400 may be textured in some or all areas around its circumference to contribute to producing erratic motion of the arm.

In other embodiments, a garment (e.g., outfit 305 of FIG. 7) worn by the toy assembly may contribute further to random motion of the arm. For example, the tightness or type of material worn around the joint area may result in irregular movement of the arm as the arm is actuated.

While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those of ordinary skill in the art, without departing from the scope of the present invention. Furthermore, those of ordinary skill in the art will appreciate that the foregoing description is by way of example only, and is not intended to limit the invention.

What is claimed is:

1. A toy appendage assembly comprising:

an elongated member having a first axis along its length, wherein the elongated member has a coupling end and a moving end, wherein the coupling end is at least partially spherical in shape and is capable of rotating within a support structure;

an offset shaft having a first end and a second end, wherein the first end is coupled to the coupling end of the elongated member, and wherein the offset shaft has a second axis along its length that is angularly offset from the first axis of the elongated member;

a wheel, wherein the second end of the offset shaft is coupled to the wheel at a location away from the center of the wheel, wherein the coupling end serves as a pivot point for the elongated member and the offset shaft, and wherein a first surface of the wheel comprises a planar portion and an inclined portion, the second end of the offset shaft being coupled to the inclined portion;

a gear coupled to the wheel; and a gear rack coupled to the gear, such that linear movement of the gear rack causes rotation of the wheel through the gear.

2. The assembly of claim 1, wherein movement of the second end of the offset shaft around a circular path on the wheel results in a non-circular movement of the moving end of the elongated member, when the elongated member is pivoted about the coupling end.

3. The assembly of claim 1, wherein the first end of the offset shaft is coupled to the coupling end of the elongated member with a pivot joint.

4. The assembly of claim 1, wherein the first axis and the second axis are offset by an angle between 0-90 degrees.

5. The assembly of claim 1, wherein the wheel has a central axis of rotation defining a third axis, and wherein the third axis is non-parallel with the second axis.

6. The assembly of claim 1, further comprising a support ring configured to serve as the support structure in which the coupling end of the elongated member rotates.

7. The assembly of claim 6, wherein the support ring provides resistance to rotation of the coupling end, causing randomized movement of the elongated member.

8. A toy assembly comprising:

a main body having an opening in a wall of the main body;

an elongated appendage having a first axis along its length, wherein the elongated appendage has a coupling end and a moving end, wherein the coupling end is at least partially spherical in shape and is capable of rotating within the opening of the main body;

an offset shaft having a first end and a second end, wherein the first end is coupled to the coupling end of the elongated appendage, and wherein the offset shaft has a second axis along its length that is angularly offset from the first axis;

a wheel, wherein the second end of the offset shaft is coupled to the wheel at a location away from the center of the wheel;

wherein a first surface of the wheel comprises a planar portion and an inclined portion, the second end of the offset shaft being coupled to the inclined portion;

a gear coupled to the wheel; and a gear rack coupled to the gear, such that linear movement of the gear rack causes rotation of the wheel through the gear.

9. The assembly of claim 8, wherein the coupling between the coupling end and the opening in the main body forms a ball and socket joint.

10. The assembly of claim 8, wherein the wheel has a central axis of rotation defining a third axis, and wherein the third axis is non-parallel with the second axis.

11. The assembly of claim 8, further comprising a support ring positioned in the opening of the main body, wherein the support ring is capable of receiving the coupling end of the elongated member.

12. The assembly of claim 11, wherein the support ring provides resistance to motion of the coupling end.

13. The assembly of claim 8, further comprising an actuation element coupled to the gear rack, wherein the actuation element is configured to move the gear rack.

14. The assembly of claim 13, wherein the actuation element comprises one of a sliding button, a push button, a rotating element, or a pivoting element.

15. The assembly of claim 8, further comprising a biasing element coupled to the gear.

16. The assembly of claim 15, wherein the biasing element is biased to return the gear rack from a displaced position to an initial position.

17. The assembly of claim 8, wherein the gear and gear rack are coupled loosely together such that slippage occurs between the gear and gear rack when the gear rack is moved.

18. The assembly of claim 13, wherein at least a portion of the actuation element is external the main body and the elongated member.

* * * * *